US010119349B2

(12) United States Patent
Umphries et al.

(10) Patent No.: US 10,119,349 B2
(45) Date of Patent: Nov. 6, 2018

(54) REDUNDANT DRILL STRING CUTTING SYSTEM

(71) Applicants: Don Umphries, New Iberia, LA (US); Gabe Williger, Dallas, TX (US)

(72) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 74 days.

(21) Appl. No.: 14/757,148

(22) Filed: Nov. 25, 2015

(65) Prior Publication Data

US 2017/0145765 A1 May 25, 2017

(51) Int. Cl.
*E21B 29/00* (2006.01)
*E21B 29/02* (2006.01)

(52) U.S. Cl.
CPC ..... *E21B 29/00* (2013.01); *E21B 29/02* (2013.01)

(58) Field of Classification Search
CPC ..... E21B 29/00; E21B 29/02; E21B 41/0078; E21B 43/114
See application file for complete search history.

(56) References Cited

U.S. PATENT DOCUMENTS 2,654,575 A * 10/1953 Kammerer ..... E21B 10/34 175/266
3,053,182 A * 9/1962 Christopher ..... B26F 3/04 102/307
3,066,735 A * 12/1962 Zingg ..... E21B 7/18 137/329.01
3,157,119 A 11/1964 Porter
3,316,970 A * 5/1967 Huitt ..... E21B 29/005 166/223
3,948,176 A 4/1976 Kooman
4,298,063 A * 11/1981 Regalbuto ..... E21B 29/02 102/308
4,494,601 A * 1/1985 Pratt ..... E21B 29/02 166/212
4,598,769 A * 7/1986 Robertson ..... E21B 29/02 166/297
4,619,318 A * 10/1986 Terrell ..... E21B 29/02 166/212
4,754,929 A * 7/1988 Struve ..... B05B 1/00 239/591
5,303,776 A * 4/1994 Ryan ..... E21B 23/06 166/147
5,435,394 A * 7/1995 Robertson ..... E21B 29/02 166/297
5,944,105 A * 8/1999 Nguyen ..... E21B 7/18 166/278
6,186,226 B1 * 2/2001 Robertson ..... E21B 29/02 166/297
7,258,054 B1 8/2007 Keeling et al.
7,387,071 B2 6/2008 Heinke et al.
9,033,032 B2 5/2015 Umphries et al.
9,677,364 B2 * 6/2017 Tallini ..... E21B 29/02
(Continued)

FOREIGN PATENT DOCUMENTS

EP 0575114 A1 * 12/1993 ..... E21B 17/1021

*Primary Examiner* — Jennifer H Gay

(57) ABSTRACT

Downhole drill pipe cutting is achieved by a free-falling sub carrying a shaped charge cutter and an ablative fluid cutter. Upon seating on a drill string flow bore orifice, fluid pressure is raised to detonate the shaped charge cutter. In the event the shaped charge cutter fails, pressure is further raised to effect a cut by fluid ablation.

16 Claims, 4 Drawing Sheets

(56) References Cited

U.S. PATENT DOCUMENTS

| | | | | |
|---|---|---|---|---|
| 2007/0012449 | A1* | 1/2007 | Cruickshank | E21B 29/04 166/298 |
| 2011/0061864 | A1* | 3/2011 | Umphries | E21B 23/00 166/255.2 |
| 2012/0211224 | A1* | 8/2012 | Umphries | E21B 23/00 166/242.1 |
| 2012/0241142 | A1* | 9/2012 | Cook | E21B 29/02 166/55 |
| 2013/0299194 | A1* | 11/2013 | Bell | F42B 1/028 166/382 |
| 2014/0034315 | A1* | 2/2014 | Tallini | E21B 29/02 166/297 |
| 2014/0262312 | A1* | 9/2014 | Tilley | E21B 34/14 166/351 |
| 2015/0075793 | A1* | 3/2015 | Dotson | E21B 31/00 166/298 |
| 2015/0369038 | A1* | 12/2015 | Brown-Kerr | E21B 29/02 166/255.1 |
| 2017/0037707 | A1* | 2/2017 | Churchill | E21B 29/00 |
| 2017/0145765 | A1* | 5/2017 | Umphries | E21B 29/00 |

* cited by examiner

REDUNDANT DRILL STRING CUTTING SYSTEM

CROSS-REFERENCE TO RELATED APPLICATION

This application claims the filing date benefit of U.S. Provisional Application Ser. No. 62/177,423 filed Mar. 13, 2015.

BACKGROUND OF THE INVENTION

Field of the Invention

The present invention relates to deep earth drilling to produce fluid minerals such as gas and oil. In particular, the invention relates to methods and apparatus for quickly and reliably severing a drill string when necessary.

SUMMARY OF THE INVENTION

In the course of deep drilling for the production of fluid minerals such as gas and oil, circumstances occasionally arise that cause the drill string to be seized in the borehole. Often, those circumstances are related to the earth formation strata through which the bore hole is drilled. Certain formations are friable and tend to collapse into a bore hole. Other formations, such a salt, are washed away by turbulent drilling fluid thereby creating cavities into which adjacent formations collapse.

Stuck hole circumstances may, to some degree, be anticipated by some knowledge of the local geology. Our U.S. Pat. No. 8,302,693 teaches new methods and apparatus for preparing a drill string for dealing with the stuck pipe problem when anticipated. The invention of our '693 patent provides sections of easily cut, sacrificial pipe that are strategically positioned along the drill string length. Tool positioning subs having bore sealing apertures also are located along drill string length at precisely known locations. These sealing apertures have progressively diminishing diameters down the pipe string length. When the exact location of the drill string seizure is found, a cutting tool is deposited in the drill string flow bore to land upon the appropriate positioning aperture. When seated, fluid pressure above the seal is raised to discharge a cutting tool firing head. The cutting tool is positioned relative to the seating aperture to discharges upon the designed weak point of the sacrificial pipe section. A successful cut of the sacrificial pipe allows the drill string above the cut to be removed from the bore hole in the normal manner. With the free portion of the drill string removed, other operations to release or by-pass the stuck pipe portion may be commenced.

Explosive shaped charges or thermite are frequently used in the oil industry for down hole pipe cutting due to speed and reliability. Although pyrotechnic pipe cutters are more reliable than competing methods of down hole pipe cutting, that reliability is not 100%: and any failure is costly. Onsite rig time is extremely expensive. When a cutter failure occurs, the unsuccessful equipment must be withdrawn from the drill string and replaced for a second attempt. If the cutting location is extremely deep, the withdrawal and replacement procedure may take many hours of rig time.

The present invention provides an immediate cutting alternative in the event of a shaped charge failure. When the known geology of a well site suggests the possibility of a well wall collapse, a drill string may be assembled with a niimher of strategically placed seating/sealing subs as taught by the prior art The present invention improves upon the prior art by providing a pair of cutters attached to a single drop sub for delivery by free-fall, pumped transport or at the end of a tubing string to a selected cut-away sub above the point of seizure. Of the cutter pair, one is an explosive shaped charge cutter and the other is a fluid ablative cutter.

When the drop sub is seated to close the drill string flow bore, fluid pressure in the flow bore is raised to open flow into the drop sub tube. Fluid pressure in the drop sub tube drives a firing head pin into a shaped charge initiation booster.

Simultaneous with the shaped charge booster ignition, ablative fluid discharge nozzles are opened. Should the desired cut not be achieved by the shaped charge, pressure in the upper drill string is raised to make the desired cut by fluid flow through the nozzles.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
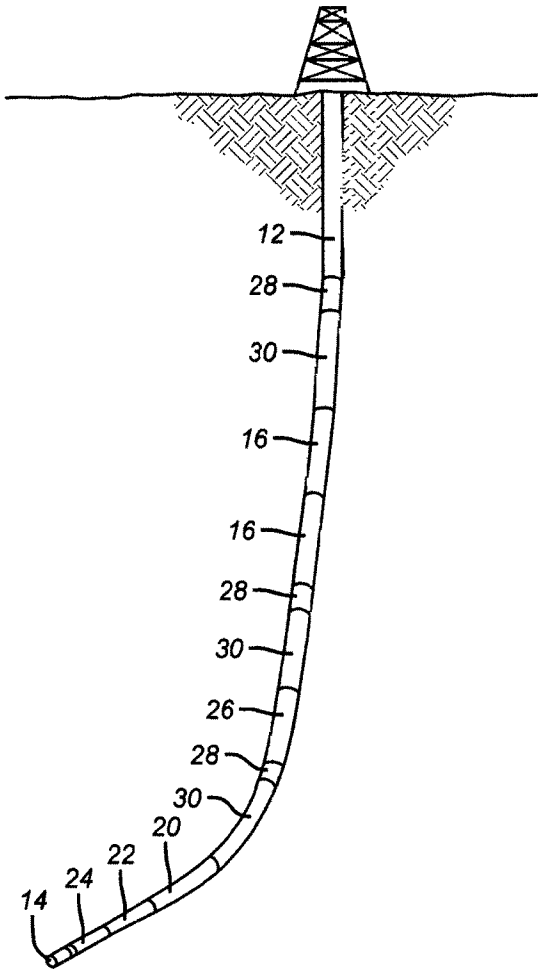
FIG. 1 is a schematic of a drill string equipped to practice the subject invention.

For orientation, the FIG. 1 schematic represents an earth bore hole containing a representative drill string assembly equipped with the present invention. In this particular example, a non-rotating drill string assembly is shown to include a downhole drill motor 20 driving a constant velocity joint housed in a bent housing 22. A bit drive housing 24 links the bent housing 22 and constant velocity joint to the drill bit 14.

Above the drill motor 20 is a cut-away sub section 30 and an associated seating aperture sub 28. In some applications, a fluid circulation powered jar 26 is included in the drill string assembly 10. If present, the jar may be placed in the drill string above the first or lowermost aperture sub 28, Above the jar 26 is another cut-away sub 30 and seating aperture sub 28.

In this example, the drill string includes a plurality of drill collars 16 for bit loading weight. The drill collars are often positioned above a second seating sub 30. Preferably, a third cut-away sub 30 and seating aperture sub 28 is provided above the drill collars 16. Traditional drill pipe 12 continues a fluid conduit linkage to the earth's surface and may include additional seating subs 30 in the assembled string.

Figure 2:
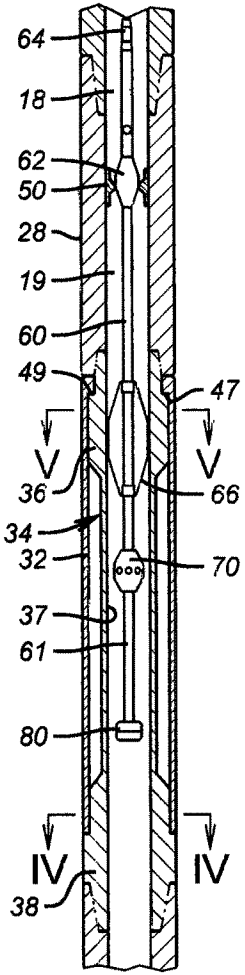
FIG. 2 is a cross-section of the invention.

Each of the cut-away subs 30 comprises a two component assembly best described by our U.S. Pat. No. 8,302,693. With respect to FIG. 2, the two constituent components include a torque sleeve 32 and a sacrificial mandrel 34. The sacrificial mandrel component has three distinct portions comprising an upper pin joint 36, a lower pin joint 38 and a thin wall tube 37 integrally linking the opposite end pin joints.

Figure 3:
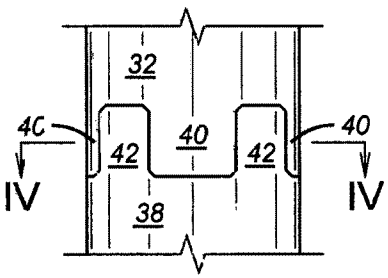
FIG. 3 is an enlarged detail of the cut-away sub lower assembly joint.
Figure 4:
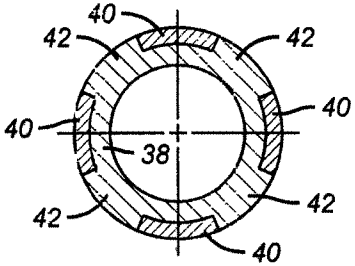
FIG. 4 is a cross-section of the cut- away sub lower assembly joint viewed along cutting planes IV-IV of FIGS. 2 and 3.

The shoulder of the lower pin joint 38 is enlarged and, as illustrated by FIGS. 3 and 4, the circumferential surface of the joint is profiled with salients 42.for receiving meshing lugs 40 of the torque sleeve 32.

Figure 5:
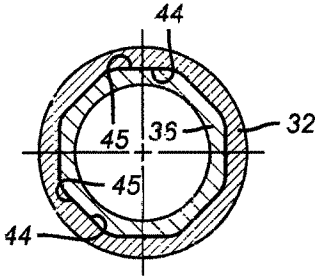
FIG. 5 is a cross-section of the cut-away sub upper assembly joint viewed along cutting plane V-V of FIG. 2.

Referring to FIG. 5, the circumferential surface of the upper pin joint 36 shoulder is cut with external wrench flats 45 while the torque sleeve 32 is cut with meshing internal wrench flats 44. Additionally, at the base of the upper joint tapered pin threads is an annular external shoulder 47 that meshes with an annular internal shoulder 49 on the torque sleeve 32.

Considering the cut-away sub 30 as an operative whole, tensile continuity is transferred along the thin wall tube 37 between the upper and lower pin joints 36 and 38, respectively. Although the thin wall tube 37 between the pin joint 36 and 38 is capable of transmitting limited torque, the torque sleeve 32 is designed to transmit the drill string primary torque load. Primarily drill string torque is transferred from the upper pin joint 36 into the torque sleeve 32 via the external and internal wrench flats 44 and 45. respectively. Similarly, torque is transferred from the torque sleeve 32 into the lower pin joint 38 via the sleeve lugs 40 and joint salients 42.

Significantly, the drill string 10 may be separated between the upper and lower pin joints by severing the thin wall tube 37. If the tube 37 is severed, and the upper portion of the drill string lifted, the torque sleeve 32 remains axially secured to the upper drill string via the mating annular shoulders 47 and 49. However, the torque sleeve lugs 40 may be axially withdrawn from the meshed salients 42 that are profiled into the lower pin joint 38. Consequently, the entire length of the torque sleeve 32 and upper pin joint 36 may be axially withdrawn from that portion of the drill string below the thin wall tube cut line.

Positioning a suitable cutting appliance along the thin wall tube length is a function of the seating aperture subs 28. In the present example, there are three such aperture subs 28. Each sub 28 has a flow bore orifice 50 that is located in the drill string at a precisely known location above an associated cut-off sub. Moreover, each orifice 50 has a unique aperture diameter in a descending order with the largest diameter aperture most proximate of the surface. A particular aperture sub 28 may be selected for a known axial distance above a particularly targeted cut-away sub 38.

Linking an appropriate cutting appliance between the desired orifice 50 and its associated thin wall tube section 37 is the function of the drop sub 60. Shown by FIG. 2, the drop sub is a tube 61 of finite length having an internal flow bore and an external plug zone 62. At the upper end of the tube 37 is a fishing neck 64 for wireline retrieval. A bore centralizer may be positioned below the plug 62 to center that portion of the sub 60 along the axis of sacrificial mandrel 34. Below the centralizer 66 are two cutting appliances, 70 and 80. The dimensional distances between the plug section 62 and the cutting appliances 70 and 80 are coordinated to the distances between the flow bore orifice 50 and the location in the pipe section where the cut is desired. In the present example, the cutting appliances 70 and 80 would be positioned in the thin wall tube section 37 of the sacrificial mandrel 34 between the shoulders of the upper and lower pin joints 36 and 38,respectively.

Figure 6A:
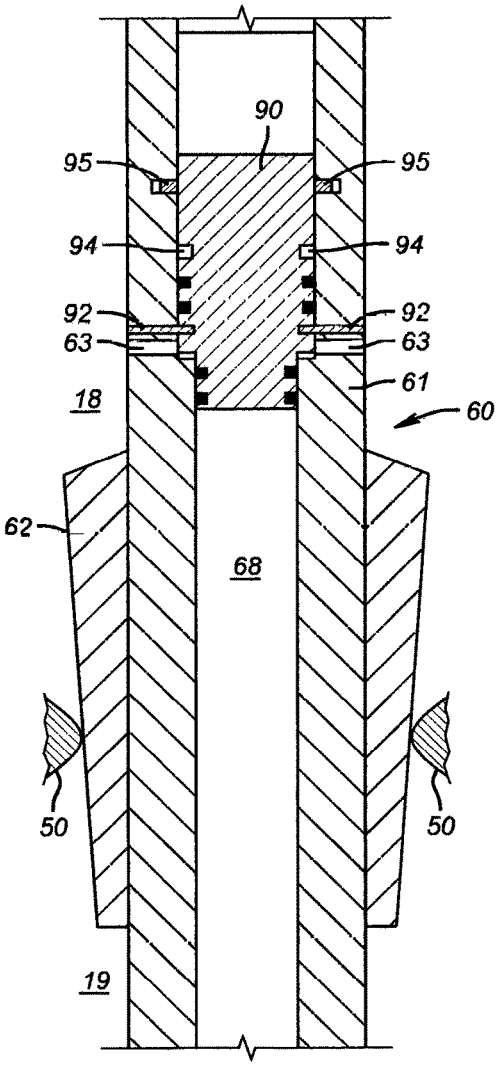
FIG. 6A is a cross-section of the drop assembly opening valve in the closed position.
Figure 7A:
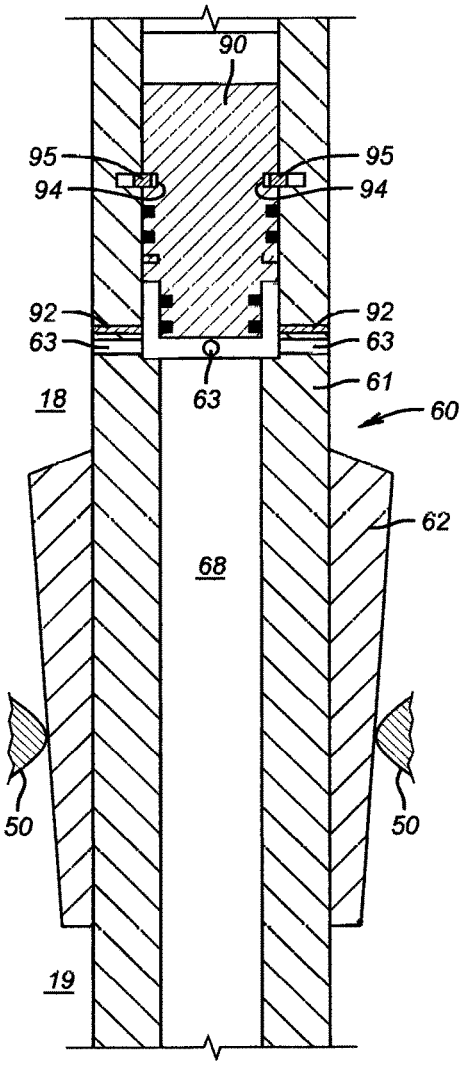
FIG. 7A is a cross-section of the drop assembly opening valve in the open position.
Figure 6B:
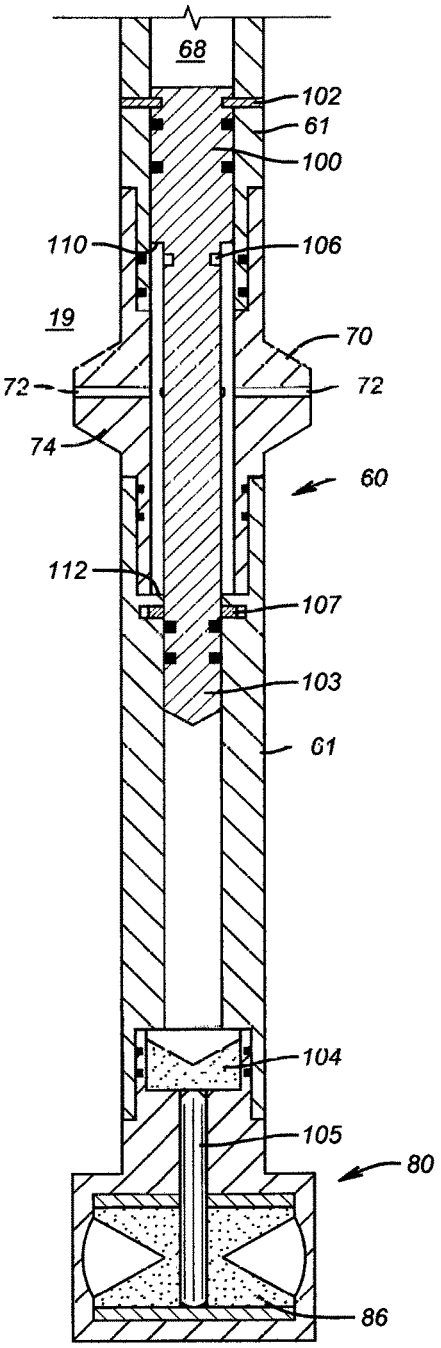
FIG. 6B is a cross-section of the shaped charge firing head position before firing.
Figure 7B:
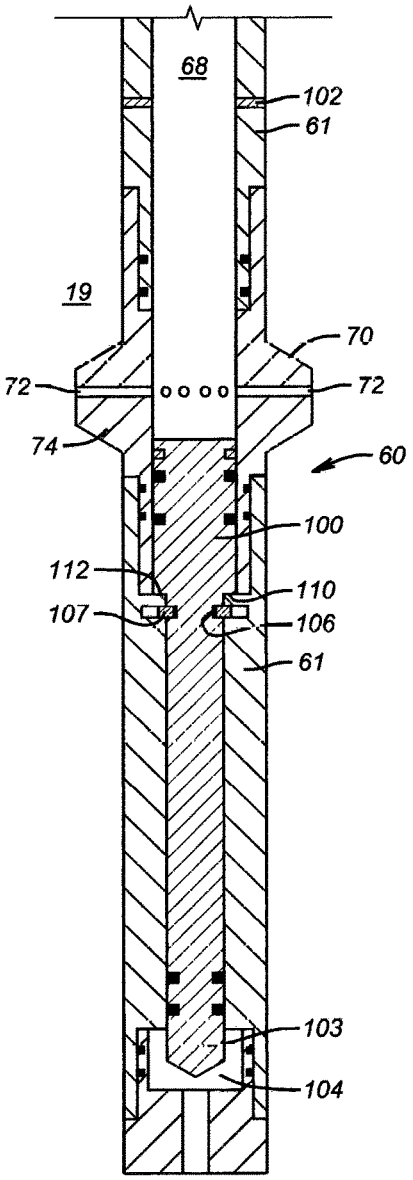
FIG. 7B is a cross-section of the shaped charge firing head position after firing.

Cutting appliance 70, shown in detail by FIGS. 6B and 7B is a multiplicity of radial nozzles 72 in a housing sub 74. Cutting appliance 80 may preferably be a pyrotechnic device such as a shaped charge explosive as shown in detail by FIG. 6B or an exothermic chemical reaction such as thermite as described by U.S. Pat. No. 6,186,226 to M. C. Robertson. An explosive booster charge 104 and detonator 105 ignites the cutter 80.

Utility of the invention begins by identifying the location of a drill string seizure along the borehole 10 length. This is accomplished by one of several procedures well known to the prior art. From knowledge of the seizure location, the most proximate cut-away sub 30 is identified and a plug section diameter 62 selected for the respective seating sub orifice 50.

If drill string circulation is possible, the drop sub 60 may be delivered to the seating sub orifice 50 by pumped fluid flow. Alternatively, the drop sub 60 may be delivered to the orifice seat 50 by gravity freefall or secured at the end of a tubing section.

As delivered against the flow bore orifice seal 50, the internal bore 68 of the drop sub tube 61 is shown by FIGS. 6A and 7A to be closed to the surrounding bore fluids by uphole piston 90. Referring to FIG. 6A, the drop sub 60 tube wall is penetrated by a plurality of apertures 63. Fluid communication from the upper flow bore 18 into the drop sub tube bore 68 is prevented by a differential area piston 90. The closed position of the piston 90 is secured by shear fasteners 92 that are calibrated to fail at a predetermined pressure in the upper flow bore 18. When the plug 62 is seated against the orifice 50, fluid pressure within the upper drill string bore 18 may be raised by surface pumps. Upon reaching the calibrated pressure in the upper flow bore 18, the shear fasteners 92 fail, thereby allowing the piston 90 to be driven upwardly where the piston channel 94 aligns with a constrictively biased snap ring 95 as represented by FIG. 7A. The snap ring closes into the channel 94 to secure the piston 90 in the aperture 63 open position. With aperture 63 open, fluid flow and pressure from the upper flow bore 18 may enter the drop sub tube bore 68 to bear upon the section area of the piston 100.

Referring to FIG. 6B, apertures 72 through the drop sub tube wall between the tube bore 68 and the lower flow bore 19 are formed as high velocity fluid nozzles. As delivered against the orifice seal 50, communication through these nozzles 72 between the flow bore 19 and the tube bore 68 is prevented by the firing head piston 100 which is secured by a shear fastener 102.

When the uphole piston 90 is shifted to open apertures 63, fluid pressure in the upper flow bore 19 enters the drop sub bore 68 to bear upon the firing head piston 100. Depending upon the failure pressure to which the shear fastener 102 is calibrated, release of the piston 100 drives the percussion pin 103 against the booster explosive 104 as shown by FIG. 7B. Ignition of the booster 104 sequentially ignites the detonation cartridge 105 and the cutter explosive 86.

It is also to be noted that the piston 100 has a greater diameter than the percussion pin 103 to provide a shoulder 100 for engaging the tube 61 bore shoulder 112. This shoulder-to-shoulder displacement limit on the piston 100 maintains a fluid flow obstruction in the tube 61 below the discharge nozzles 72 thereby forcing fluid flow through the sub bore 68 to exit through nozzles 72

As the percussion pin engages the booster 104, the piston channel 106 aligns with the constrictively biased snap ring 107 to secure the piston 100 in the down position shown by FIG. 7B against the explosion pressure from the booster 104 detonation. In this FIG. 7B position, the nozzles 72 are open between the drop sub bore 68 and the lower drill string bore 19. High pressure fluid discharges through the nozzles 72 directly against the thin wall tube 37. Those of ordinary skill in the well drilling arts know the pipe cutting capacity of high pressure fluids carrying abrasive particles.

Figures 8A, 8B, 8C, 8D, 8E, 8F:
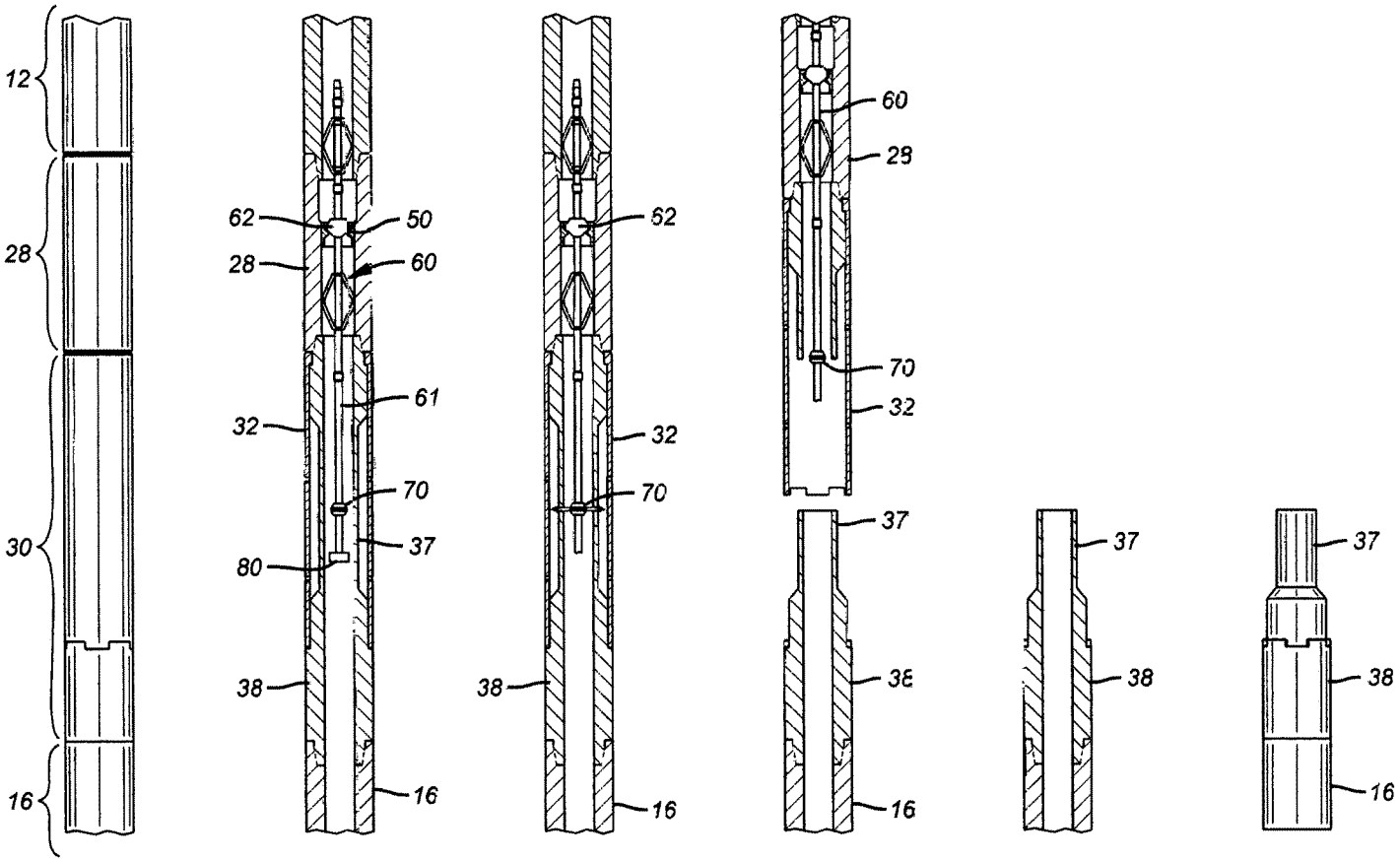
FIG. 8A illustrates a section of pipe string having seating sub and cut-away sub units inserted between the drill motor and a jar.
FIG. 8B is a sectioned view of FIG. 8A showing a drop assembly within the pipe string in pipe cutting position.
FIG. 8C is a sectioned view of FIG. 8A showing the discharge of a hydraulic jet cutting tool after failure of a shaped charge against a reduced wall annulus section of the sacrificial mandrel.
FIG. 8D is a sectioned view of the severed pipe section of FIG. 8C showing withdrawal of the upper pipe section from the severed lower pipe section.
FIG. 8E is a sectioned view of the severed pipe stub remaining below the cut of FIG. 8C.
FIG. 8F is a full profile view of the severed stub remainder of the pipe section.

The process heretofore described is further illustrated by FIGS. 8A-8F. FIG. 8A shows a section of drill string between the upper drill pipe 12 and a drill collar 16.which includes a seating aperture sub 28 and a cut-away sub 30. FIG. 8B represents the same section of drill pipe presented in cross-section. Particular attention is directed to the drop sub 60 and the plug section 62 seated against the flow bore orifice 50. An extension of the drop sub tube 61 below the plug section 62 aligns a hydraulic cutter 70 and a shaped charge cutter 80 within the flow bore 19 below the orifice 50 and adjacent the thin wall tube section 37. In this FIG. 8B position, the drop sub plug 62 is seated on the orifice 50 and the upper flow bore 18 pressure is raised to open apertures 63. With the orifices 63 open, upper flow bore pressure enters the drop sub tube bore 68 and bears upon firing head piston 100.

When the calibrated pressure on firing head piston100 is reached and shear pin 102 fails, the firing head piston 100 drives the percussion pin 102 into the booster charge 104 to detonate the cutter explosive 86. If the cutter is successful, the upper portion of the pipe 12 may be lifted away from the lower, stuck portion as illustrated by FIGS. 8D and 8E FIG. 8C illustrates an event that is highlighted by failure of the explosive cutter 80 to sever the thin wall tube section 37. However, the nozzles 72 are now open to fluid pressure imposed from surface pumps through the upper flow bore 18. Increased pressure of ablative fluid across the nozzles 72 will cut the tube wall, albeit, more slowly. but only by comparison to the instant cut of the shaped charge—if successful.

With the thin wall tube 37 successfully severed, the upper drill string 12 is lifted from the surface to disengage the torque sleeve 32 lugs 40 from the lower pin joint profiled salient 42 as shown by FIG. 8D.

While a preferred embodiment of the invention uses the drop sub 60 in combination with a cut away sub 30, those of ordinary skill in the art will immediately appreciate the utility of the drop sub 60 independently of any cut-away sub 30 for the purpose of cutting a pipe string at any required or designated location.

Although the invention disclosed herein has been described in terms of a specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A pipe cutting sub comprising:

a stem tube having an internal flow bore and an external collar plug for forming a fluid seal with a pipe flow bore orifice;

a first aperture through a wall of said stem tube axially above said collar plug;

a cutting appliance comprising a plurality of fluid discharge orifices through said stem tube wail axially below said collar plug and above a distal end of said stem tube for discharging high pressure ablative fluid;

a pyrotechnic pipe cutter secured to said stem tube;

a percussion detonated explosive booster within said stem tube proximate of said pyrotechnic pipe cutter;

a pressure operated valve piston within said internal flow bore having a first position to close said first aperture and a second position to open said first aperture;

a firing head piston within said internal flow bore having a first position to close said fluid discharge orifices and a second position to open said fluid discharge orifices; and a percussion pin within said internal flow bore for detonating said explosive booster when said firing head piston is moved to said second position.

2. The pipe cutting sub described by claim 1 wherein said pyrotechnic pipe cutter is a shaped charge explosive.

3. The pipe cutting sub described by claim 1 wherein said pyrotechnic pipe cutter comprises an exothermic chemical reaction.

4. The pipe cutting sub described by claim 1 wherein said pyrotechnic pipe cutter comprises thermite.

5. The pipe cutting sub described by claim 1 wherein said cutting sub is independent of cable or tubing support for freefall placement in a well bore.

6. The pipe cutting sub described by claim 1 wherein said cutting sub is secured to a tubing string.

7. The pipe cutting sub described by claim 1, further comprising a centralizer, wherein the first aperture is located axially above said centralizer and the cutting appliance is located axially below said centralizer.

8. A method of assembling a well pipe cutting tool comprising the steps of:

providing an elongated tubular wall having a flow bore;

providing a seating collar around said wall between distal ends of said tubular wall;

providing an aperture in said tubular wall between said seating collar and a first distal end of said tubular wall;

providing a pyrotechnic pipe cutting appliance proximate to a second distal end of said tubular wall;

providing a cutting appliance comprising a plurality of fluid discharge orifices in said tubular wall between said seating collar and said pyrotechnic pipe cutting appliance, said discharge orifices aligned to discharge high pressure ablative fluid flow through said orifices in a plane substantially normal to a length of said tubular wall;

providing an aperture closure plug in said flow bore that opens said aperture when displaced by fluid pressure external of said tubular wall between said seating collar and said first distal end;

providing a fluid discharge orifice closure plug in said flow bore that is displaced by fluid pressure in said flow bore to open said discharge orifices; and providing a percussion pin for displacement along said flow bore by displacement of said orifice closure plug, said percussion pin displacement initiating said pyrotechnic pipe cutting appliance.

9. The method described by claim 8, further comprising the step of providing a centralizer around said elongated tubular wall, wherein the aperture is provided axially above said centralizer and the cutting appliance is provided axially below said centralizer.

10. A method of cutting a well pipe comprising the steps of:

providing a cutting tool having an elongated tube for supporting along a length thereof, a bore sealing collar around said tube, a pyrotechnic pipe cutting appliance and, between said sealing collar and said pyrotechnic pipe cutting appliance, a fluid cutting appliance;

positioning said cutting tool sealing collar upon a seating orifice in a well pipe flow bore to isolate an upper zone of said well pipe flow bore above said seating orifice from a lower zone below said seating orifice;

providing a first fluid pressure on said well bore upper zone for detonating said pyrotechnic appliance in said lower zone; and when said pyrotechnic appliance has not severed said well pipe, raising fluid pressure in said well pipe upper zone to discharge ablative fluid through said fluid cutting appliance for severing said well pipe.

11. The method described by claim 10, further comprising the step of providing a centralizer around said elongated tube, wherein the sealing collar is provided axially above said centralizer and the fluid cutting appliance is provided axially below said centralizer.

12. A system for severing a downhole pipe string comprising:

a downhole pipe string having a tool seating sub selectively positioned along a flow bore of said pipe string;

a cut-away sub positioned in said pipe string proximate of said seating sub, said cut-away sub comprising a thin wall section of interior pipe surrounded by an exterior torque sleeve;

a drop-sub comprising a flow tube having a fluid sealing collar around an exterior of said flow tube, a cutting appliance comprising a plurality of fluid cutting nozzles, and a pyrotechnic pipe cutter positioned along a length of said flow tube in respective order below said sealing collar; and said drop-sub positioned in said pipe string flow bore with said fluid sealing collar engaging said seating sub to separate an upper well portion from a lower well portion and to position said pyrotechnic pipe cutter and fluid cutting nozzles adjacent said thin wall pipe section.

13. The system for severing a downhole pipe string described by claim 12 wherein an aperture in said flow tube is opened by fluid pressure in said upper well portion.

14. The system for severing a downhole pipe string described by claim 13 wherein a pyrotechnic firing pin is driven by fluid pressure in said flow bore.

15. The system for severing a downhole pipe string described by claim 11, wherein displacement of said firing pin opens said fluid cutting nozzles to fluid flow from within said flow bore.

16. The system described by claim 12, further comprising a centralizer around said flow tube, wherein the fluid sealing collar is located axially above said centralizer and the cutting appliance is located axially below said centralizer.

* * * * *